US005380342A

United States Patent [19]

Leonard, III et al.

[11] Patent Number: 5,380,342

[45] Date of Patent: Jan. 10, 1995

[54] METHOD FOR CONTINUOUSLY CO-FIRING PULVERIZED COAL AND A COAL-WATER SLURRY

[75] Inventors: Joseph W. Leonard, III, Lexington, Ky.; Robert D. Stoessner, Johnstown, Pa.

[73] Assignee: Pennsylvania Electric Company, Johnstown, Pa.

[21] Appl. No.: 85,629

[22] Filed: Jul. 2, 1993

Related U.S. Application Data

[63] Continuation-in-part of Ser. No. 608,986, Nov. 1, 1990, abandoned.

[51] Int. Cl.[6] ..... C10L 1/00; F23B 7/00; F23N 1/00

[52] U.S. Cl. ..... 44/280; 110/341; 110/347; 431/2; 431/12

[58] Field of Search ..... 44/280, 457, 602, 605; 110/341, 347; 431/9, 12

[56] References Cited

U.S. PATENT DOCUMENTS

| | | | |
|---|---|---|---|
| 52,208 | 3/1866 | Whelpley | 44/605 |
| 137,820 | 4/1873 | Berney | 44/605 |
| 449,102 | 3/1891 | Andrews | 44/280 |
| 2,128,913 | 9/1939 | Burk | 44/280 |
| 2,560,368 | 7/1951 | Richards et al. | 44/457 |
| 2,822,864 | 2/1958 | Black | 431/284 |
| 2,941,585 | 6/1960 | Loebel et al. | 431/284 |
| 3,168,350 | 2/1965 | Phinney et al. | 44/280 |
| 3,341,256 | 9/1967 | Adams | 44/280 |
| 3,456,987 | 7/1964 | Hughes et al. | 44/457 |
| 3,589,314 | 6/1971 | Tratz | 110/28 |
| 3,682,114 | 8/1972 | Scheubel et al. | 110/7 S |
| 4,205,929 | 6/1980 | Schiffman | 44/280 |
| 4,304,572 | 12/1981 | Wiese et al. . | |
| 4,353,712 | 10/1982 | Marion et al. | 431/6 |
| 4,402,275 | 9/1983 | Weiner | 44/605 |
| 4,432,771 | 2/1984 | Sawyer, Jr. . | |
| 4,444,126 | 4/1984 | Förster | 110/238 |
| 4,455,148 | 6/1984 | Nagata et al. | 44/280 |
| 4,465,495 | 8/1984 | Scheffee | 44/280 |
| 4,501,205 | 2/1985 | Funk | 110/347 |
| 4,515,602 | 5/1985 | Keller, Jr. . | |
| 4,529,408 | 7/1985 | Yan . | |
| 4,722,740 | 2/1988 | Donnelly . | |
| 4,749,381 | 6/1988 | Yaghmaie . | |
| 4,762,528 | 8/1988 | Reichl . | |
| 4,803,932 | 2/1989 | Siwersson et al. | 110/260 |
| 4,915,706 | 4/1990 | Daley . | |
| 5,048,433 | 9/1991 | Green et al. | 110/347 |

*Primary Examiner*—Margaret Medley
*Attorney, Agent, or Firm*—Abdallah & Muckelroy

[57] ABSTRACT

A process is provided for burning a coal water slurry comprising providing clean coal fines of less than 100 mesh at about 50 weight % and water at about 50 weight % by co-firing the coal water slurry in a continuous stream with a separate stream of pulverized coal wherein about 80% of the total BTU output of the furnace is provided from the pulverized coal and approximately 20% of the BTU output is provided from the coal water slurry. First, a quarl in the furnace is preheated using natural gas, for example. The furnace is next fired with a fuel source of 60% pulverized coal and 40% natural gas. A coal water slurry with fines of minus 100 or smaller is subsequently gradually introduced into the furnace as the gas input is gradually decreased.

7 Claims, 5 Drawing Sheets

METHOD FOR CONTINUOUSLY CO-FIRING PULVERIZED COAL AND A COAL-WATER SLURRY

This application is a continuation-in-part of application Ser. No. 07/608,986 filed on Nov. 1, 1990 which was copending at the time of the filing of this application and now abandoned.

BACKGROUND OF THE INVENTION

1. Field of the Invention

The present invention relates to a method for producing and managing fines and more specifically to a method for pressure spraying and burning a coal dust-water mixture. The invention also relates to a method and system for co-firing a unique coal water slurry (CWS) with conventional pulverized coal (PC) utilizing a unique application of conventional, commercially available equipment.

2. Description of the Prior Art

Costly interruptions to flow and serious environmental dust related problems often occur when handling raw coal at mines, processing plants, power plants and other utilization facilities. The flow of pulverized coal in water is frequently interrupted by blockages caused by unevenly distributed and widely varying wet fines content. Even with well designed materials handling systems, such blockages continue to occur in storage and transport facilities such as bins, railroad cars, silos, chutes, stockpiles, pipes, conveyors, feeders, and air ducts, for example. Well designed systems fail because they completely overlook the detrimental role played by the unfavorable physical properties of bulk coal. Moreover, dust problems are frequently caused when some fine sizes located at or near the surface of the bulk coal become dry and entrain in the atmosphere during transport and handling.

It is important, therefore, that wet fine coal be carefully managed to prevent both blockages and dust losses. Blockages can be prevented by initially separating fines from coarse coal during wet processing at mine sites, and transportating the fines in slurry pipelines to the point of utilization separately from the conventionally transported bulk coarse coal. Dust losses to the environment can be prevented by burning the slurry; or, at some point ahead of the boiler, injecting or packaging the slurry well within the coarse coal. Packaging will prevent the fines in the slurry from locating near the surface and drying and dusting off into the atmosphere. These methods also differ from prior art since they permit the elimination of costly fine coal dewatering and drying at the mine site. Burning of the pulverized coal and slurry in the novel process reduces the cost of energy from coal pulverization at the power plant. The energy cost is greatly reduced because of the use of the previously removed fines as fuel.

To eliminate both blockages and dust losses, problem causing fines are initially removed from coal and later systematically remixed as a slurry to control the coal fines content and bulk physical properties. Fines removal takes place at the mine site during wet processing where the fines are pumped in slurry and later recombined with the conventionally transported coarser pulverized coal. The novel recombination takes place within the furnace. The coal water slurry is cofired and used as a fuel in large steam generators.

BACKGROUND OF THE INVENTION

Heretofore the cofiring of coal water slurries with pulverized coal on a commercial basis has not been achieved. From a utility company standpoint it is desirable to cofire a coal water slurry fuel at for example the rate of slurry produced from a 100 ton per hour fine coal cleaning and byproduct coal water slurry production facility. To be economically viable it is necessary that a furnace for burning coal water slurry or CWS fuel be able to burn a CWS slurry containing 50% solids for coal particles by weight.

In the coal burning industry coal particles are often referred to as fines and the size of the particles is defined by their capacity to pass through a particular mesh filter. Low cost coal fines or coal particles can be derived from particle coal streams and operating coal processing plants or coal ponds comprising a mixture of coal particles and water. The prior art has determined that the economics for the use of coal fines or particles favor the use of less than 100 mesh coal particles or coal fines which are classified or removed from a course coal stream of greater than 100 mesh fines or particles.

When less than 100 mesh coal fines or particles are processed into a CWS slurry it is unnecessary to use stabilizers, disbursants or to utilize additional energy to produce the less than 100 mesh coal particles or ultrafine coal by grinding of larger pulverized coal pieces.

In 1891 Andrews was granted U.S. Pat. No. 449,102 which generally disclosed the mixing of coal dust with water to form a coal water slurry to be transported through pipes or the like to reservoirs, ponds or tanks. In 1936 Burke was issued U.S. Pat. No. 2,128,913 for an improvement in the coal water slurry process for transporting coal by changing its state to a pumpable fluid by grinding the coal and mixing the disintegrated coal with water and a small amount of water soluble soap and then coagulating the suspending agent, for example, adding a mixture of lime to recover the coal.

U.S. Pat. No. 2,791,471 entitled "Transportation of Coal by Pipeline" described and claimed a coal water slurry comprising coal particles mixed with water having a spectrum of sizes with a nominal top size in the range of 6 to 28 mesh Tyler standard screen series and having less than 25% by weight of particles having the size greater than 14 mesh. The patent further indicated that the coal particles having the aforementioned size distribution and nominal top size were mixed with water to prepare a slurry comprising 35% to 55% by weight of the coal particles and the remainder water. The patent further disclosed that the slurry was pumped through a long distance pipe line at a linear velocity of between 4 to 7 feet per second and recovered at the delivery end of the pipeline.

U.S. Pat. No. 3,168,350 issued to Phinney in 1965 recognized that one important limitation of a slurry prepared according to the aforementioned recipe requires the expenditures of a significant amount of energy to convey the slurry through a long distance pipeline. Phinney also recognized that the slurry according to the recipe is unstable and that under static conditions the coal particles quickly settle out of the slurry as a highly immobile mass. Phinney was able to considerably reduce the energy necessary to convey the slurry described by blending in a prescribed manner two quantities of coal each having a different spectrum of particle sizes and mixing the blended coal particles with water. The synergistic discovery was that the energy requirements of the slurry prepared from the blended coal particles was less than the energy requirements to transfer slurries prepared from either of the two quantities having a different spectrum of sizes alone. In other words what was discovered was that by blending two slurries each having a different spectrum of coal particles both with high transportation energy requirements a slurry was obtained which had a transportation energy requirement less than either of the two slurries originally employed in the blend. What Phinney discovered was to blend relatively course coal particles having a spectrum of sizes and a nominal top size of 4 mesh of the spectrum with relatively fine coal particles having a substantial quantity of particles smaller than 325 mesh.

Adams in U.S. Pat. No. 3,341,256 issued in 1967 and entitled "Process for Conveying Mineral Solids Through Conduits" describes the procedure at the time for pipeline transport of coal as first pulverizing the coals to a size range in which practically all the coal is less than $\frac{1}{8}$ inch with approximately 30% passing through 200 mesh screen and then incorporating water to create a pumpable slurry. Adams pointed out that techniques had been devised to burn the slurry directly but this resulted in a reduction of thermal efficiency. Adams developed a thixotropic mixture to defeat settling velocity of large coal particles settling rapidly through the low viscosity water of the slurry. This thixotropic means comprised a fluid or gel prepared from a mixture of water, leonardite, sodium hydroxide and calcium oxide. This thixotropic fluid in various proportions was discovered to be an excellent suspension medium for pipeline transportation of solid materials such as coal. Unfortunately after transport the solid materials, mainly the coal had to be separated from the gel.

U.S. Pat. No. 3,589,314 issued in 1971 to Tretz for a method and device for pressure spraying and burning a coal dust-water mixture. Tretz pointed out that in 1971 experiments were being carried out internationally to develop methods for directly burning mixtures of coal dust and water in power plants. However, the then state of the art mixture contained about 60% coal dust and 40% water by weight.

Tretz discloses the direct combustion of the then state of the art coal dust water slurry after direct transport through a pipeline. The mixture was burned after spraying into a furnace or burner via a high pressure rotary sprayer or spray nozzle. Tretz's method discloses burning a prior art coal water slurry where prior to discharging the slurry from a nozzle at a pressure of several atmospheres the slurry is heated to a temperature just below the water-vaporizing temperature upstream of the nozzle so that the water is pressure-relieved and vaporizes directly after passing through the nozzle.

The coal water slurry is accumulated in a funnel shaped supply vessel from which it is supplied to the burners of a power plant upon demand. The supply vessel is adapted to stir or agitate its contents to prevent settling of the coal dust from the slurry. The coal water slurry is preheated in a heat exchanger with superheated steam.

In another embodiment of the invention the coal water slurry is heated in a nozzle by a suitable electric heating device surrounding the nozzle. A temperature sensing device located down stream of the electric heater controls a regulated voltage source which provides energy to the heater adapted to the nozzle.

The Tretz method for burning a coal water slurry is limited to a 60%/40% prior art coal dust to water mixture or slurry by weight.

In 1980 U.S. Pat. No. 4,250,929 was issued to Schiffman for a coal water slurry utilizing brine instead of fresh water.

In 1981 Wiese was issued U.S. Pat. No. 4,304,572 for a method of producing a pumpable CWS slurry with a high solid content. Wiese points out that coal as mined contains varying amounts of water which in some instances may range up to 40% by weight or even higher in the case of low grade coal. Wiese suggests that even this 40% water content is an undesirable constituent of the fuel. It is pointed out that if solid fuel is to be transported by pipeline in the form of a slurry, water trapped in the pores of the solid fuel which takes no part in the formation of the slurry are also transported. Thus, the slurry containing 50% by weight water and 50% by weight solid fuel would contain considerably less than that amount of fuel when the fuel therein is measured on a dry basis.

The amount of water necessary to form a pumpable slurry depends according to Wiese on the surface characteristics of the coal. In the case of a slurry which is to be fed to a gas generator Wiese suggests it is necessary that the coal be ground to such an extent that a major portion thereof will pass through a 200 mesh sieve so that the particles are small enough to be substantially completely converted to oxides of carbon during their short residence time within the gasification zone in a gas fired furnace. Wiese teaches that for the slurry to be pumpable it must be made up of solid fuel particles most of which will pass through a 200 mesh sieve and that the coal water slurry contain from about 55 to 60 weight percent water. Wiese further points out that a slurry containing this amount of water renders the operation of the gas fired furnace unsatisfactory. The excess water moderates the temperature of the reaction zone to such an extent that it is thermally inefficient. Assuming a gas fired furnace Wiese suggests that a suitable amount of water for a coal water slurry used to feed a gas generation zone is between 40 and 50 wt. % and preferably between 40 and 45 wt. %. A limitation specifically in the Wiese patent is that the coal dust pass through a 200 mesh sieve and that the water content range between about 40 and 50 wt. %. It is further disclosed that sodium hydroxide and potassium hydroxide are added to the slurry. The percentage of BTU supplied to the furnace by the coal water slurry as compared to that supplied by the gas fuel is not disclosed.

In 1984 Sawyer, Jr. was granted U.S. Pat. No. 4,432,771 for a combustible coal water slurry mixture and method for preparing same. The composition disclosed is a coal water slurry containing 65 to 70 wt. % coal. What is suggested is using coal for example, anthracite, semi-anthracite, bituminous as well as semi-bituminous, fresh crushed and ground by conventional techniques to a fairly fine powder. Examples of successful grinds disclosed are coal powders such as (a) 95% 100 mesh, 80% of 200 mesh, and 65% of 325 mesh; (b) 90% 100 mesh, 75% of 200 mesh, and 52% of 325 mesh; and (c) 100% of 325 mesh (44 microns) and 55% of 26 microns. The upper limit on the coal particles size is dictated by what will burn in the flame (for example 80 mesh). The amount of coal that can be incorporated into a coal water mixture slurry is suggested to be a function of the particle size distribution, the particle shape and the disbursing agents employed. Particle size distribution and particle shape can be established during a drying process or by post-processing of the slurry with various conventional wet grinding equipment to achieve a change in particle size distribution and a rounding off of particle shapes.

It was previously believed generally necessary to incorporate a maximum amount of coal in the slurry. The problem in the prior art was to maximize the coal and maintain rheological characteristics that assure good stability and spray ability in the burner nozzle for combustion.

The maximum solids in a coal water slurry is suggested in the prior art to be about 70% to 75% and a satisfactory slurry is suggested to only be attained with relatively round particles, a high percentage of fine particles and a disbursing/wetting agent. For any medium to long range stability, a gelling agent that imparts gel properties to the continuous water phase according to the prior art, was required.

Forster in U.S. Pat. No. 4,444,126 issued in 1984 discloses an apparatus for combustion of a suspension of coal particles in water or CWS. Combustion air preheated to 550 degrees C. is forced into a coal water slurry preheated to 100 degrees C. in a portion of a burner upstream of the burner flame. Air passes into the preheated suspension through a porous wall which is preheated and it separates the end portion of the air duct from the suspension duct. Preheating is done by recuperators, through which the combustion product gases from the furnace flow before being discharged at a temperature low enough for evaporating the condensed water.

Four months later Scheffee in U.S. Pat. No. 4,465,495 disclosed a process wherein a high fuel value coal water slurry is directly injected into a furnace as a combustible fuel for the express purpose of supplanting large quantities of increasingly expensive fuel oil used by utilities, factories, ships and other commercial enterprises. Scheffee teaches the slurry should be loaded with finely divided coal in amounts as high as 50 wt. % to 70 wt. % of the slurry. Scheffee is generally directed towards burning of highly loaded coal water slurries which are fluidic dispersion characterized as thixotropic or Bingham fluids having a yield point.

In 1985 U.S. Pat. No. 4,501,205 was issued to Funk for a process for burning a coal water slurry containing at least 60% volume carbon solids. Funk suggests again that coal water slurries prepared with a carrier liquid are unstable at solids contents exceeding about 50 wt. %.

Funk indicates that the prior art discloses that the use of more than about 50 wt. % of coal in a coal-oil mixture has an adverse effect upon the pumpability of the mixture. In August 1978 U.S. Pat. No. 4,094,035 issued to Cole et al contained a disclosure that a coal water slurry with more than 50 wt. % of coal was unpumpable.

Liquid fuels, coal water slurries included, according to the prior art must be vaporized before they can be burned. Most large capacity industrial burners use two steps to get liquid carbonation fuel into combustible form—atomization plus vaporization. Atomization is the process of breaking a liquid into a multitude of tiny droplets. BY first atomizing the liquid carbonation fuel or coal water slurry and thus exposing the large surface area of millions of tiny droplets to air and to heat atomizing burners are able to vaporize liquid carbon based fuel at very high rates. See, "North American Combustion Handbook", Second Edition (North American Manufacturing Company, Cleveland, Ohio, 1978), pages 251 and 418.

Generally the prior art discloses that the viscosity required for coal water slurry for effective atomization is substantially lower than the viscosity required to effectively pump the slurry. In summary, the prior art teaches that carbon based slurries containing more than about 50 wt. % coal cannot be effectively atomized and burned. First because they cannot be pumped to the atomizer. And, because of a solids contents of greater than 50 wt. % they are unpumpable. Second, even when the slurries have a low enough viscosity to be pumpable they often have too high a viscosity to be effectively atomized and burned. Funk thus discloses a process for burning a carbonaceous slurry having at least 55 volume % carbon material whereby the slurry is atomized and subsequently combusted. A burner which utilizes a coal water slurry is described in a publication by T. M. Sommer and J. Funk entitled "Development of a High-Solid, Coal-Water Mixture for Application as a Boiler Fuel" which was contributed by the Fuels Division of the American Society of Mechanical Engineers for presentation at the joint ASME/IEEE Power Generation Conference, Oct. 4–8, 1981, St. Louis, Mo. (pps. 1–4); the disclosure of this publication is hereby incorporated by reference herein as prior art.

The prior art coal water slurry generally described by Funk is comprised of a fine or fine slurried product of a concentration of preferably more than about 50 wt. % of solids. A fine consist is combined with a course consist of coal particles having a mean particle size which exceeds 40 microns. The course and fine fractions are then combined with each other, a carrier liquid and a disbursing agent to produce a grinding mixture comprised of from about 60 to about 82 vol. percent of coal, from about 18 to about 40 volume percent of carrier liquid or water, and from about 0.01 to about 4.0 wt. % of disbursing agent.

Keller, Jr. et al in U.S. Pat. No. 4,515,602 issued in 1985 describes another prior art composition containing coal and water which can be used as a fuel. Keller correctly points out that it is part of the prior art that dwindling supplies of petroleum and natural gas and concerns about the regular availability of those products from foreign sources have led to increased interest by utilities and other consumers in the use of coal water slurries as an alternative fuel. Coal water slurries reported in the patent and open literature for the most part have a particle size distribution of 60–80% plus or minus 200 mesh (74 microns)×0 and ash contents of 3 plus to over 10 wt. %. Such mixtures are described in the patents previously discussed herein and in the following papers, all presented at the Fourth International Symposium on Coal Slurry Composition, Orlando, Fla., May 10–12, 1982: K. Aoki et al, Pretreatment of Coal for Coal Water Slurries, Sumitomo Heavy Industries, Ltd.; R. Bori et al, Coal-Oil Mixture and Coal-Water Mixture Fuels for Steam Generators, Combustion Engineering, Inc.; G. Germane et al, Coal Water Mixture Combustion Studies in a Laboratory Cylindrical Combustor, Combustion Laboratory, Brigham Young University; Ghassemzadeh et al, Rheology and Combustion Characteristics of Coal-Water Mixtures, Babcock and Wilcox Company; and R. Scheffee et al for the development of a evaluation of coal-water mixture technology, Atlantic Research Corporation. The Keller coal water slurry disclosed has a particle size distribution of less than or equal to 30 microns×0 and an ash content that can range down to 1.5 to less than 0.3 wt. %. In one example Keller points out that the resulting coal water slurry has a solids concentration of 50 wt. % and an absolute viscosity of 3300 centipoises at a shear rate of $5^{-1}$ seconds.

SUMMARY OF THE INVENTION

A coal water slurry containing about 50% solids wherein the solids, coal fines of 100 mesh or smaller, are utilized for about 20% of the BTU source for a furnace by cofiring with pulverized coal. The process involves utilizing a gas fired boiler modified to burn a combination of pulverized coal and a clean coal water slurry without additives. The process comprises preheating a ceramic quarl in the furnace with natural gas to approximately 550 degrees C. and introducing the coal water slurry and then backing down the natural gas until 20% of the BTUs are supplied by the coal water slurry. At this point pulverized coal is introduced into the furnace. Pulverized coal is introduced at the rate of at least 2% per minute of the total BTUs and the natural gas is reduced or backed down at substantially the same rate until an approximately 80% pulverized coal and 20% coal water slurry fuel mix based on total BTU output is burned in the furnace.

OBJECTS OF THE INVENTION

It is accordingly an object of the present invention to provide: a method to (1) enhance coal flow and burn the entire flow using a portion in a slurry to eliminate costly down time blockages during handling; (2) reduce windage and fugitive dust losses to improve the environment; (3) eliminate costly fine coal dewatering and drying facilities at a coal preparation plant and (4) significantly reduce or eliminate grinding facilities and/or cost of grinding at pulverized coal burning power plants. These and other objectives are achieved by providing a slurry by cleaning the bulk coal and removing minerals during transport and handling and subsequently co-firing the slurry with pulverized coal.

Broadly in the practice of the invention application thereof is made to any bulk coal containing a full range of processed or unprocessed sizes being handled, transported or stored between the point of final consumption or utilization.

It is thus an object of the invention to provide a process for the cofiring of a clean 50% coal water slurry with pulverized coal.

It is a further object of this invention to provide a process wherein the cofiring of a clean 50% coal water slurry with pulverized coal is economical from a utility standpoint and capable of burning the coal water slurry produced with a substantially reduced NOx emission rate.

It is a further object of the invention to provide a cofiring process which utilizes low cost coal fines derived from fine coal streams, operating coal processing plants, and/or coal ponds.

It is yet another further object of the invention to provide a cofiring process which utilizes coal particles having a size less than 100 mesh classified from a coarse coal stream without the use of stabilizers, dispersants or the production of ultra-fine coal by grinding.

In addition, it is yet another object of this invention to provide a cofiring process whereby a cleaned coal water slurry fuel with 50% solids and viscosities as low as 100 centipoise at 100 reciprocal seconds is burned continuously and provides 20% of the BTU output of a furnace or power generating station.

Furthermore, it is still another object of the invention to provide a cofiring process whereby the coal water slurry fuel is no more than 50 wt. % solids and generated from coal pond fines, from the fine coal fractions of existing coal supplies or is supplied from a coal processing plant which deep cleans fine coal for maximum removal of mineral matter including pyritic sulfur.

It is yet a further object of this invention to provide a cofiring technique and process wherein a coal water slurry having approximately 50 wt. % solids is utilized as a continuous fuel to eliminate fine coal handling problems at the user's site including the elimination of fine coal dryers and their associated environmental problems at the coal preparation site.

It is still yet another object of this invention to provide a cofiring process whereby pulverizer life is extended by reducing the load to the pulverizer, for example, by providing coal water slurry fuel for as much as 41% of the firing rate.

It is yet another object of the invention to provide a cofiring process which is modulated by altering periodically the firing rate of the coal water slurry to reduce heat load on the pulverizers.

DESCRIPTION OF THE INVENTION

In accordance with the invention certain fine sizes of a coal to be provided, such as the minus 100 mesh fractions, are split off from coarser material. The split-off fines are then mixed with water to produce a pumpable slurry with about a 50% solids content. The slurry is then stored and subsequently used to provide a stable input of fines for co-combustion with pulverized coarse coal.

An optional step is to later reintroduce the slurry into a flow of coarser material via a flow controller according to a computer controlled system controlling timing, location and amount of slurry to be introduced. By employing a computer controlled sequence for introducing and re-introducing slurry back into the coarser coal both flow and undesirable dust misplacement are greatly improved.

The automated control of fines content and introduction is tailored to match the co-firing parameters. For example, if bin flow blockages occur, the coarser fractions are first introduced into the bin followed shortly by mechanical dispersion of the fines back into the coarser material. This sequence places the coarser and more flowable sizes at the bottom of the bin, so that when a feeder mechanism located at the bottom and more flow restrictive area of the bin is activated, smooth and continuous flow of material for continuous co-firing of slurry and coarse coal results.

The method may also suppress windage and fugitive dust losses in stockpiles. To do this the dispersion of fines into the coarser sizes being placed on stockpiles is interrupted by the computer controller at some point in time before final deposition of the stockpiles. This assures that the outer layer of the stockpile is substantially free of environmentally transient fines.

If the transport of coal through a multi-unit facility is interrupted because of flow blockages, the mechanical dispersion of fines back into the coarser material is metered by the computer controller and altered to yield the best fines build-up distribution compatible with the storage and transport units within the system.

The coarse stream is maintained as an entity separated from the slurry. Hence, the coarse stream of pulverized fines is introduced into a boiler separately from the slurry.

Figure 1:
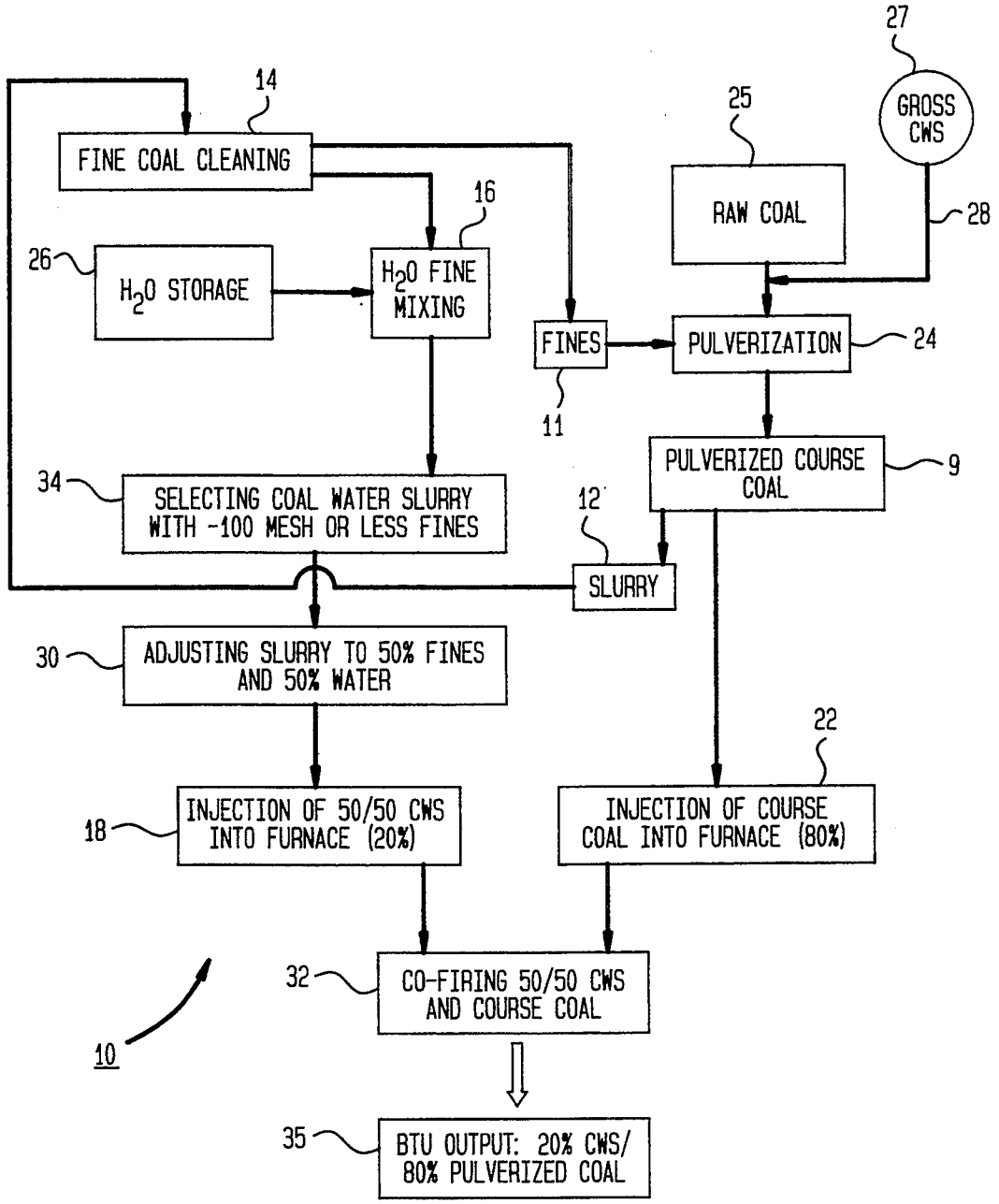
FIG. 1 is a flow diagram illustrating steps in the novel process.

Referring to FIG. 1, non-conventional auxiliary combustion of clean slurry is shown co-fired with combustion of pulverized coarse coal 9, in a process 10. The fines 11 are initially split off in a slurry 12 and the slurried fines are cleaned in a step 14. The solids content is adjusted in a step 30. A slurry 12 may includes chemical additives like calcium lignosulfonate as a dispersant, for example.

The Slurry 12 after cleaning 14 is subsequently injected in a step 18 into a pulverized coal, gas fired boiler through separate ports via the step 18 distinct from a step 22 used to inject the pulverized coarse coal. In this preferred embodiment of the novel process 10 the fines 11 are a by-product of a pulverization step 24 and mixed in step 16 with water from a storage tank 26.

Where conventional combustion of coal is in process, the coarse coal and slurry may be recombined at one or more selected points ahead of the pulverization step 24 at the power plant. For example, slurry 12 may be recombined with the pulverized coarse coal 9 at transition points during shipment when loading and unloading of bins, railroad cars, silos, stock piles, etc. This new gross slurry or gross CWS 27 may be reintroduced and distributed within raw coal 25 in a step 28 in pre-controlled amounts through one or more pipes located within or around the free falling coarser coal as the raw coal 25 is discharged at some higher elevation from a conveyor belt, for example. The pulverized course coal 9 is dried before being used in the injection step 22.

An optimum formulation is indicated in step 30. The formulation allows co-burning fine coal 32 as Coal Water Slurry (CWS) with pulverized coal from a pulverization step 24 fed by raw coal 25. A critical aspect of the novel method for utilizing fine coal without expensive drying of the fines 11 before combustion is shown by step 34. No drying is necessary when step 28 is bypassed or shut down.

Co-firing combustion has been successfully conducted burning low solids CWS in a co-firing mode 35 with pulverized coal as shown in step 32. In step 34, CWS is provided from −100 Mesh coal from a coal preparation plant classifying cyclone overflow. This coal is cleaned. The degree of cleaning is to at least about 9.4% to 12.4% ash and about 1% sulfur as illustrated generally in FIG. 5.

Some co-firing results, obtained are presented below in Table 1.

TABLE 1

| | CWS Characteristics (−100 Mesh Coal) Viscosity | | | |
|---|---|---|---|---|
| Sample | Percent Solids | Dispersant | 100 sec−1 | 1000 sec−1 |
| 1 | 61.50 | 1.00% | 232 | 136 |
| 2 | 61.35 | 0.75% | 504 | 230 |
| 3 | 61.30 | 0.50% | 308 | 148 |
| 4 | 60.75 | 0.25% | 540 | 318 |
| 5 | 60.36 | 0.00% | 764 | 318 |
| 6 | 57.14 | 0.00% | 478 | 134 |
| 7 | 50.00 | 0.00% | 112 | 34 |

A satisfactory CWS without dispersants low solids loadings of 50% was burned as a fuel. The low solids CWS (50% moisture content) without dispersants was not a barrier to use of this slurry as a fuel. In the novel process, a low solids (50% water) CWS is an acceptable boiler fuel when co-fired with pulverized coal using the novel method further illustrated in the flow chart shown in FIG. 2.

The impact of 50% CWS moisture on total moisture in a coal fired boiler is that CWS moisture at 50% solids and a 20% firing rate increases the flue gas moisture by only about 15%.

Figure 3:
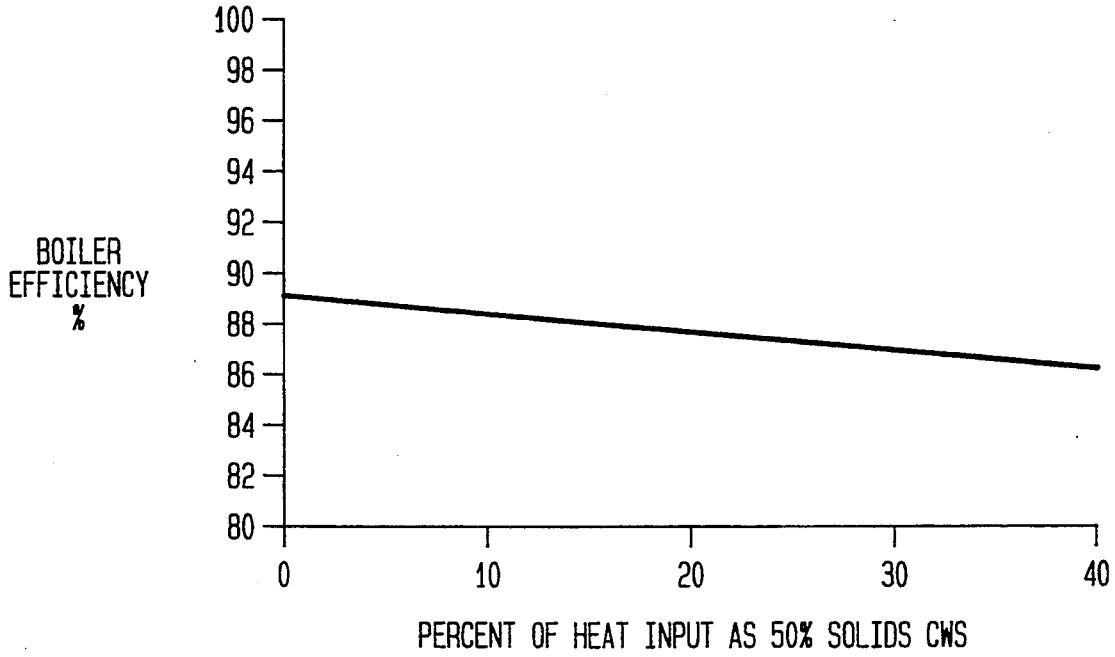
FIG. 3 is a graph is illustrating the boiler or furnace efficiency using the novel co-firing method versus percentage of heat input for 50% solids CWS.

FIG. 3 illustrates the 50%/50% CWS effects on boiler efficiency.

Figure 2:
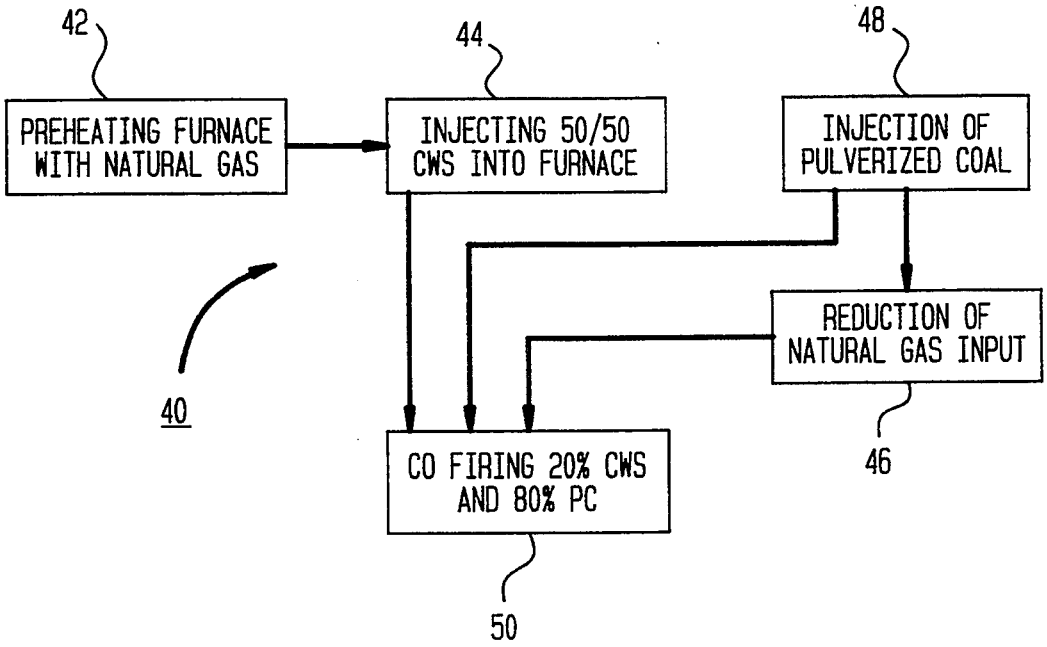
FIG. 2 is another flow diagram illustrating additional steps in the novel process.

A very unusual positive effect of the higher emissivity of CWS over coal has also been discovered in a 1.5 million Btu/hour gas fired boiler modified to burn pulverized coal or PC and CWS using the part of the novel method 40 charted in FIG. 2. These burns comprise the step 42 of preheating a ceramic quarl in the furnace with natural gas; the next step comprises the step 44 of introducing a 50%/50% CWS; then the step 46 comprises reducing the in flow of natural gas until 20% of the BTU's are supplied by the CWS. At this point, next pulverized coal is introduced as shown in step 48 and the natural gas is simultaneously reduced in step 46 until an 80 percent PC and 20 percent CWS fuel mix is being burned as illustrated in step 50. The slurry is initially atomized and burned at a rate of 60% CWS and 40% natural gas.

Referring back to FIG. 1 as shown in step 24 in the novel method pulverized coal 9 is provided. Fine coal or fines 11 as shown in step 11, cleaned by froth flotation, is initially supplied as a filter cake containing 60% solids, 10.5% ash, and 1.2% sulfur, for example.

Initially, CWS fuel or the slurry 12 is produced ranging from 45% to 55% solids by mixing and the addition of water as shown by step 16 of FIG. 1.

Some gas composition results of co-firing with about 50% solids are summarized in Table 2.

TABLE 2

| | Combustion Tests | | | | | | | | |
|---|---|---|---|---|---|---|---|---|---|
| | | | | | Gas Composition | | | | |
| Test | % P.C. | % CWS | Firing Rate | % Solids | O2 | CO | CO2 | SO2 | NOx |
| 1 | 85 | 15 | 1.85 | 47.6 | 3.6 | 830 | 13 | 763 | 683 |
| 2 | 79 | 21 | 1.75 | 47.6 | 3.7 | 745 | 14.7 | 774 | 676 |
| 3 | 59 | 41 | 1.75 | 50.8 | 4.1 | 1461 | — | 638 | — |
| 4 | 79 | 21 | 1.72 | 56.0 | 4.3 | 729 | 14.3 | 628 | 482 |
| 5 | 100 | | 1.67 | | 4.8 | 214 | 13.7 | 812 | 767 |

A significant drop in NOx level when firing the CWS is shown. This is the positive effect of the higher emissivity noted above.

Air Sparged Hydrocyclone flotation processing equipment may be incorporated into a test loop in a CWS production plant. (See FIG. 4).

Figure 4:
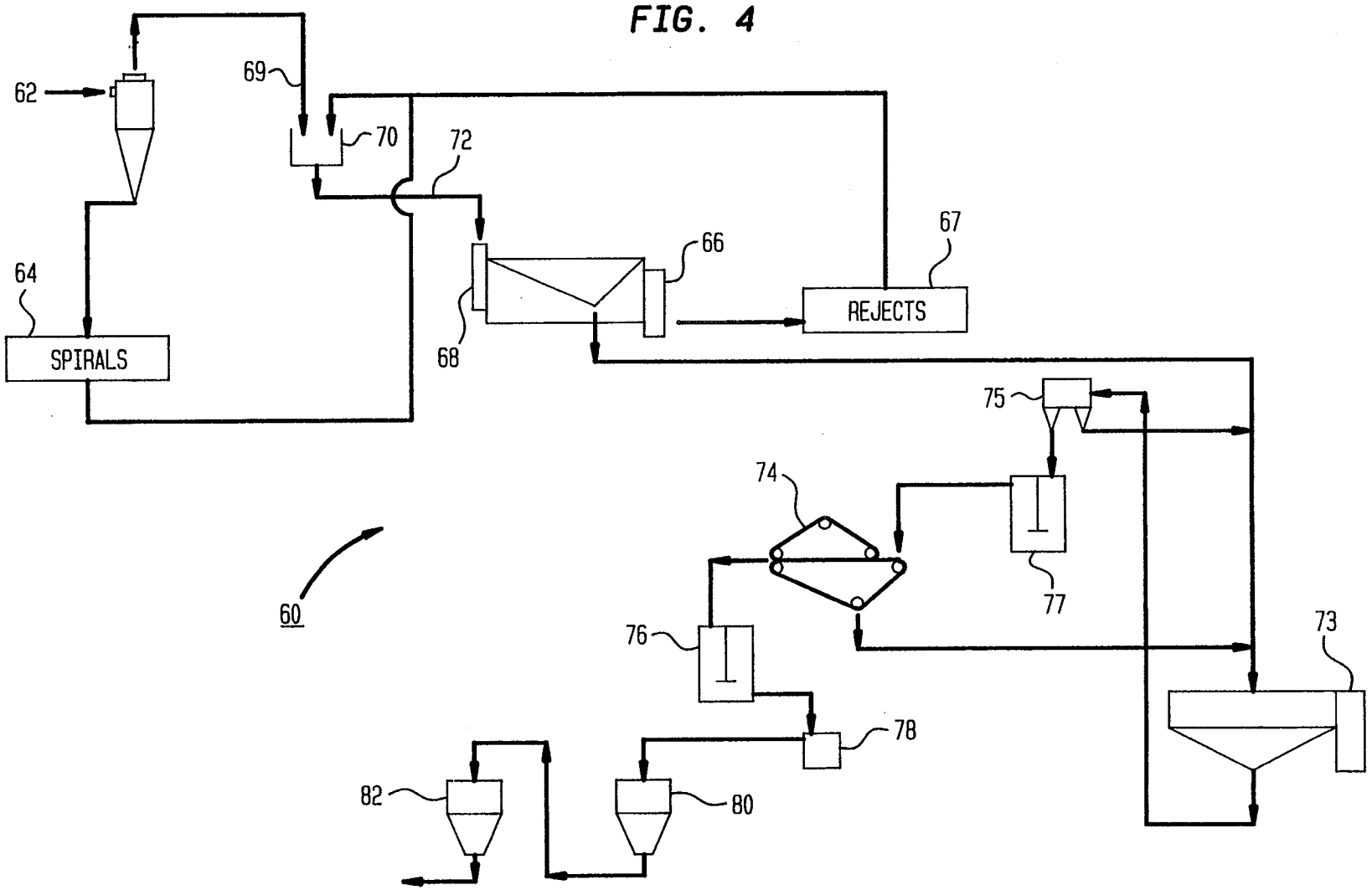
FIG. 4 is a flow and block diagram illustrating essential steps in a plant for cleaning fines to produce a preferred coal water slurry whose fines content is adjusted using the method illustrated in the block diagram of FIG. 1.

The overall novel method is based on cleaning out fine coal from coarse coal and producing CWS. The generic design 60 is shown schematically in FIG. 4. In the novel method clean −100 coal is eventually produced and used. The cleaning (step 14 of FIG. 1) as shown in FIG. 4 involves pyrite removal in classifying cyclones 62 and spiral separators 64 and ash removal by a conventional froth flotation member 66 and/or by a air sparged hydrocyclone 68.

The classifying cyclone 62 produces −100 mesh coal in the classifying cyclone overflow 69. About 30% of the −100 mesh coal is misplaced to the underflow. Consequently, a cleaning circuit involving spirals 64 to process 28 mesh×0 classifying cyclone underflow is also used. The spiral circuit cleans the 28×100 mesh coal, rejecting ash and pyritic sulfur but recovers the misplaced −100 mesh coal. This coal is recycled via a collector 70 for the entry 72 into the main froth flotation circuit members 66 and 68. The slurry is then directed to a thickener 73 then via a diverter box 75 to a floculator 77. The system includes the air sparged hydrocyclone 68 in a loop in one of the steps used for ash removal and coal recovery.

The process equipment further operates as follows: Rejects 67 are returned to the collector 70. The CWS output of the diverter box 75 to a filter press 74 is then mixed in tank 76 and further mixed in a in-line high shear mixer 78. The CWS is then directed to a recirculation tank 80 for output to a holding tank 82 to supply the slurry 12 (shown in FIG. 1).

Figure 5:
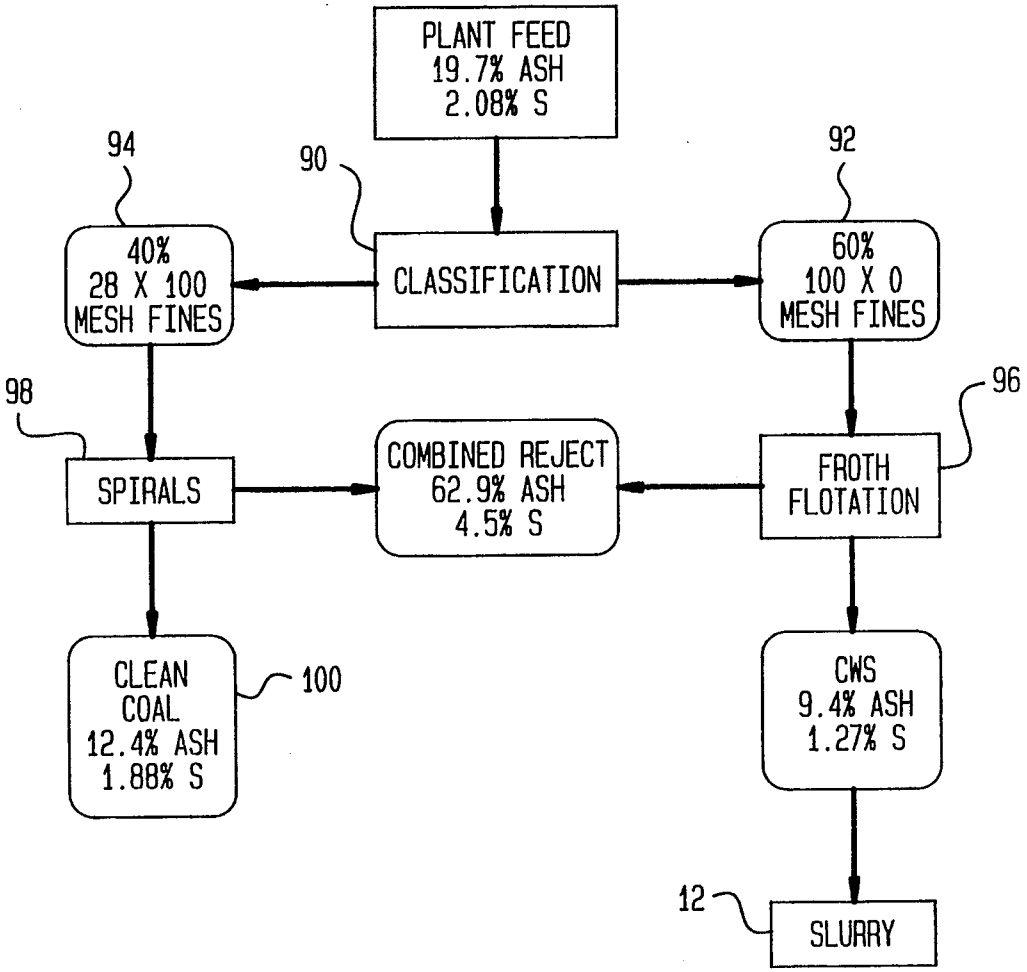
FIG. 5 is a flow and block diagram showing classification of a coal plant feed to produce a preferred slurry.

Referring now to FIG. 5, raw coal 25 (See FIG. 1) via a plant fed step 89 is classified in existing classifying cyclones via the step 90. The −100 mesh fine 92 in the overflow is cleaned by froth flotation 96. The 28 mesh×100 mesh fines 94 in the underflow cleaned in spirals 98. Misplaced −100 mesh clean fine in the spiral is recovered by screening. The recovered fines are combined in step 100 with raw −100 mesh coal fines.

A sampling of batches is used to select clean coal and CWS from a list of coal seam types. The CWS properties are evaluated and selected to insure that no chemical formulations are present. Secondly, continuous test runs are preformed in which the plant is operated continuously in conjunction with the main cleaning plant. The types of coal being supplied by the cleaning plant are identified and the coal variability effects on CWS characteristics are determined.

In the preferred process low cost coal fines may also be derived from fine coal streams of operating coal processing plants or coal ponds. Further, in the process the use of −100 mesh coal classified from a coarse coal stream and processed into CWS fuel without the use of stabilizers, dispersant or the production of ultra-fine coal by grinding is preferred. About fifty percent solids CWS fuels with viscosities as low as 100 centipoise at 100 reciprocal seconds are used in the novel process.

The novel process described shows co-firing a CWS utilizing −100 mesh coal to eliminate thermal dryers.

Referring again to FIG. 5, there is shown a summary flow diagram of a fine coal cleaning and CWS production facility. Minus 28 mesh coal is received at the cleaning plant and classified in classifying cyclones. The minus 100 mesh fraction, at 2 to 5% solids is cleaned in froth flotation equipment. The plus 100 mesh coal is cleaned in spiral concentrators. Misplaced −100 mesh coal in the spiral stream is recycled to the froth cells. The spiral clean coal is dewatered by centrifuges. The combined refuse from the spiral and froth flotation circuits is dewatered using a belt filter. The clean froth product is concentrated in a thickener and filtered in a belt press to produce a filter cake with 70 to 75% solids.

As shown by FIGS. 1, 2 and 4 the filter cake is re-dispersed using pumps, high shear mixers and the addition of water to form a stable CWS fuel of 50% water and 50% clean coal fines of −100 mesh for co-firing.

While specific embodiments of the invention have been shown and described in detail to illustrate the application of the process of the invention, it will be understood that the invention may be embodied otherwise to accomplish the equivalent work without departing from the principles of the novel invention.

What is claimed is:

1. In a modified gas fired boiler having a quarl therein wherein the boiler produces a heat output, a process for co-firing an aqueous coal slurry consisting essentially of approximately 50 weight % coal up to 100 mesh fines and approximately 50 weight % water and pulverized coal comprising the steps of: (a) preheating the quarl in the boiler by combusting natural gas therein; (b) adding an atomized aqueous coal slurry at a rate of 60% CWS and 40% natural gas; while simultaneously (c) reducing said gas to wherein 80% heating in said boiler is by said gas; and then (d) introducing pulverized coal; and then, (e) further reducing the inflow of said gas until (f) co-firing pulverized coal and aqueous coal slurry wherein approximately 80% of the heat output from said boiler is produced by firing said pulverized coal and wherein approximately 20% of the heat output from said furnace is from firing said aqueous slurry whereby the aqueous coal slurry is subsequently co-fired continuously with the pulverized coal.

2. The process in claim 1 further comprising a step of cleaning said coal fines by froth flotation.

3. The process in claim 2 wherein said coal fines are produced from a filter cake contain approximately 60 weight % coal, 10.5 weight % ash, 1.2 weight % sulfur with water constituting the balance of the mixture.

4. The process in claim 2 wherein said coal fines are removed by said froth flotation from a pulverized coal and water mixture comprising approximately 60 weight % coal, 10.5 weight % ash, 1.2 weight % sulfur.

5. The process of claim 1 wherein said coal fines approximate are 100 mesh.

6. The process of claim 5, wherein the step of preheating the quarl inside said boiler further comprises heating said quarl to approximately 550 degrees Centigrade.

7. The process of claim 6 wherein said gas is decreased at a rate to wherein approximately 20% heating is from said aqueous slurry, said rate being at least 2% per minute of the total heat output of said boiler and subsequently wherein the pulverized coal is introduced into the boiler at a rate of approximately 2% per minute of the total out put of the boiler, whereupon approximately 80% of the heat output of said boiler is attained and maintained by the firing of pulverized coal.

* * * * *